US005209697A

United States Patent [19]

Hurst et al.

[11] Patent Number: 5,209,697

[45] Date of Patent: May 11, 1993

[54] BLOWER SYSTEM FOR A DUCT

[76] Inventors: Donald P. Hurst, 21179 Panama, Warren, Mich. 48091; Billy H. Finley, 6412 Genaw, Algonac, Mich. 48001

[21] Appl. No.: 832,967

[22] Filed: Feb. 10, 1992

[51] Int. Cl.[5] ..... F24F 7/06; F24C 15/20

[52] U.S. Cl. ..... 454/341; 126/299 D; 454/67

[58] Field of Search ..... 454/16, 49, 67, 341, 454/354; 415/182.1, 201, 213.1; 126/299 D

[56] References Cited

U.S. PATENT DOCUMENTS

| | | | |
|---|---|---|---|
| 2,203,491 | 6/1940 | Euwer | 415/201 |
| 2,568,278 | 9/1951 | Favot | 454/233 X |
| 2,800,849 | 7/1957 | Spear | 454/354 X |
| 3,425,621 | 2/1969 | Greenhick | 415/201 X |
| 4,537,117 | 8/1985 | Cavestany et al. | 237/46 X |
| 4,647,295 | 3/1987 | Christ | 454/341 X |

OTHER PUBLICATIONS

Gaggenau Built-in Kitchen Equipment Information Booklet, Gaggenau USA Corp., Norwood, Mass., dated before Jan. 1, 1992, which shows installations of blower units.

Modern Maid Information Booklet and Information Sheet on Model PHU185, Modern Maid Co. Division of Raytheon Company, Topton, Pa., dated before Jan. 1, 1992, each of which show installations of blower units.

General Electric Showcase of Products, General Electric Company, USA, dated before Jan. 1, 1992, which shows installations of blower units.

Sterling New Product Review, Sterling Domestic Products, Inc., Norwood, Mass., dated before Jan. 1, 1992, which shows installations of blower units.

Thermador Products Booklet, Thermador Division of Masco Corporation, Los Angeles, Calif., dated before Jan. 1, 1992, which shows installations of blower units.

Jenn-Air Expressions Collection Information Booklet, Jenn-Air Company, Indianapolis, Ind., dated before Jan. 1, 1992, which shows installations of blower units.

Dacor Distinctive Appliances Information Booklets: a) Kitchen Planning Guide, b) 4400/6600 Ventillation Systems, c) Pinnacle Raised Ventilation System, and d) Electric Convertible Cooktops, Dacor Distinctive Appliances, Pasadena, Calif., dated before Jan. 1, 1992, each of which shows installations of blower units.

Miele Built-in Appliances Information Booklet, Miele Appliances, Inc., Somerset, N.J., dated Apr. 1990, which shows installations of appliances.

Magnetek Replacement Motor Manual 191, p. 23, dated before Jan. 1, 1992, discloses blower units.

*Primary Examiner*—Harold Joyce

*Attorney, Agent, or Firm*—Peter D. Keefe

[57] ABSTRACT

A blower system for a duct, locatable anywhere along the duct. The blower system is composed generally of a blower and a housing connected to the blower. The housing encloses the blower and has connected thereto an inlet port and an outlet port for being connected with a duct at any location along the duct. More particularly, the housing includes an internal baffle having a cut-out which interfaces with the outlet of the blower. Further, the housing is provided with an adapter that is tapered between the baffle and the outlet port for facilitating movement of air from the blower to the duct. A power cord emanates sealably from the housing for connecting the blower to a source of electrical power.

3 Claims, 2 Drawing Sheets

BLOWER SYSTEM FOR A DUCT

BACKGROUND OF THE INVENTION

1. Field of the invention

The present invention relates to blower devices used in connection with ducting. More particularly, the present invention relates to a blower system locatable anywhere along a duct.

2. Description of the Prior Art

Home, commercial and industrial environments frequently involve production of undesirable fumes and odors in enclosed spaces. These gases, which range the gamut from being a mere nuisance to being a serious life threat, must be removed from the enclosed space in a safe and efficient manner.

In the prior art, it is know to remove these gases by operation of a duct and blower combination. The duct serves as a conduit for the gases from the enclosed space to the outside air, and the blower is located at one or the other end of the duct and serves to move the gases along the duct to the outdoors.

One case of particular interest is the production of smoke and odor during the process of grilling foodstuffs in a kitchen. Manufacturers of cooktops typically provide a ventilation system in which a vent is located adjacent the grill unit. The vent is connected via a duct to the outside air, and a blower unit is used to move odorous and smokey air from the kitchen through the vent, along the duct to the outdoors. The blower unit is connected to the duct at either end. In the case of an interior mounting, the blower unit connects with the vent via a short connector duct, and is located generally in the space occupied by the appliance. In the case of an exterior mounting, the blower unit is located outside the building where air is exhausted to the outdoors.

While either conventional installation mode, interior or exterior, does provide excellent air movement from the kitchen to the outdoors, significant problems are nonetheless present. With respect to interior mounting of the blower unit, noise and vibration of the blower unit are detectable to the homeowner, resulting in a substantial amount of annoyance; with respect to exterior mounting, the blower unit is unsightly and subject to degredation due to exposure to the elements.

Accordingly, what is needed in the prior art is a blower system that is located neither at the appliance nor exterior to the building.

SUMMARY OF THE INVENTION

The present invention is a blower system for a duct in which the blower unit is locatable anywhere along the duct.

The blower system according to the present invention is composed generally of a blower and a housing connected to the blower. The housing encompasses the blower and has an inlet port and an outlet port for being connected with a duct at any location along the duct. More particularly, the housing includes an internal baffle having a cut-out which interfaces with the outlet of the blower. Further, the housing is provided with an adapter that is tapered between the baffle and the outlet port for providing and facilitating movement of air from the blower to the duct. A power cord emanates sealably from the housing for connecting the blower to a source of electrical power.

Accordingly, it is an object of the present invention to provide a blower system for a duct which may be located anywhere along the duct.

It is a further object of the present invention to provide a blower system for a duct in which a blower is located within a housing and further in which the housing includes a construction which optimizes air flow from the blower to the duct.

These, and additional objects, advantages, features and benefits of the present invention will become apparent from the following specification.

DETAILED DESCRIPTION OF THE PREFERRED EMBODIMENT

Figure 1:
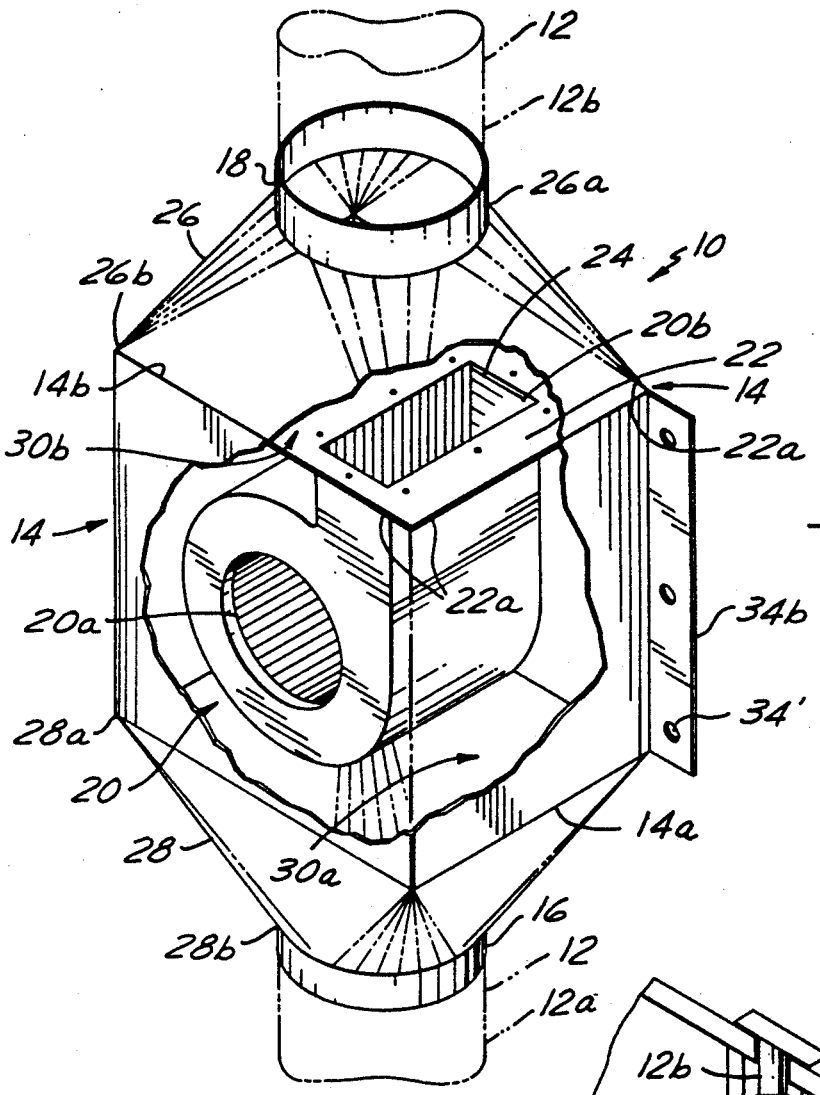
FIG. 1 is a perspective view of the blower system according to the present invention, shown in operation in connection with a duct.
Figure 4:
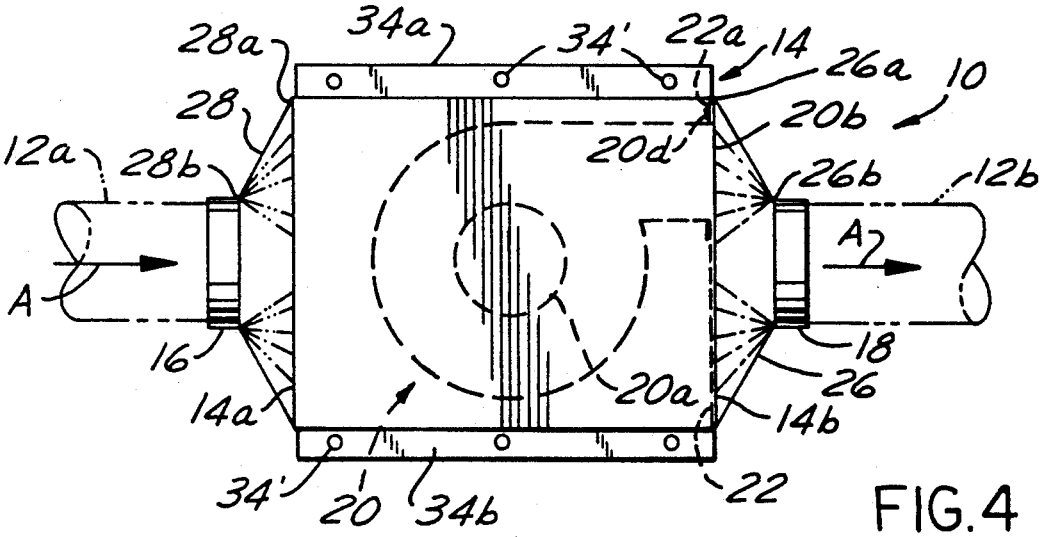
FIG. 4 is a side view of the blower system according to the present invention, shown in operation as depicted in FIG. 1.
Figure 5:
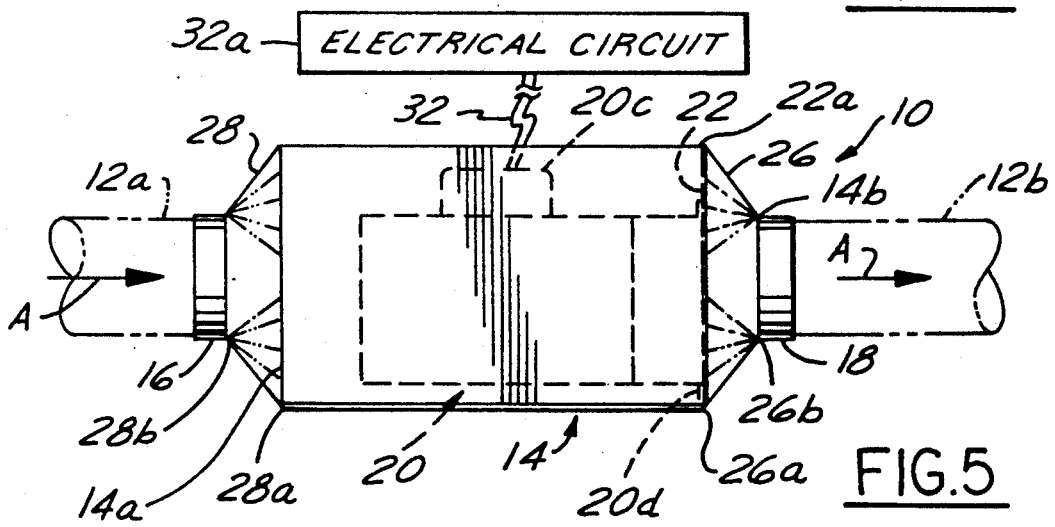
FIG. 5 is a top plan view of the blower system according to the present invention, shown in operation as depicted in FIG. 1.

Referring now to the Drawing, FIG. 1 shows the blower system 10 according to the present invention in operation with respect to a duct 12. The blower system 10 is composed generally of a housing 14 having connected therewith an inlet port 16 and an outlet port 18, and an electrically powered blower 20. A first duct portion **12*a* of the duct 12 connects with the inlet port 16, while a second duct portion 12*b* of the duct connects with the outlet port 18. Accordingly, the blower when actuated causes air A to flow from the first duct portion 12*a* to the second duct portion 12*b*, and the location of the blower system 10 is arbitrary along the duct 12. Specific structural and functional details will be elaborated with reference being made to FIGS. 1, 4 and 5**.

The blower 20 is preferred to be in the form of a standard high capacity centrifugal blower of the type well known in the art, having one or two air inlets **20*a* and a single air outlet 20*b*, and being powered by an electrical motor 20*c*. The air passage defined by the air outlet 20*b* is conventionally, but not necessarily, of an elongate rectangular shape, and is structured to include a mounting bracket 20*d* having holes for receiving fasteners, such as bolts or rivets for mounting the blower 20**.

The housing 14 is constructed of a sheet metal material and is structured to enclose and support the blower 20. The housing is further structured to interface with the duct 12 by operation of an inlet port 16 and an outlet port 18, wherein the inlet and outlet ports are structured to sealably mate with, respectively, the first and second duct portions **12*a*, 12*b*** in a conventional manner, such as with the aid of duct tape or an adjustable band clamp.

In order to provide a base for connection of the blower 20 to the housing 14 and further in order to provide control of air movement within the housing in response to actuation of the blower, a baffle 22 is connected to the housing. The baffle 22 is structured in the form of a partition wall which sealably connects on all sides thereof with respect to the housing 14 adjacent the outlet port side thereof. An aperture 24 is provided in the baffle 22 which is dimensioned to match the dimensions of the air outlet 22*b* of the blower 20. Further, the baffle 22 is provided with holes 26 which align with the holes in the mounting bracket 20*d* of the blower 20 so that a common fastener can pass therethrough each and thereby secure the blower to the baffle, with the air outlet being sealably mated with the baffle at the perimeter of the aperture 24.

Located between the outlet port 18 and the baffle 22 is an outlet port adapter 26. It is preferred for the outlet port adapter to have a first shaped end 26*a* that sealably connects with a second end 14*b* of the housing at the periphery 22*a* of the baffle 22, and to taper smoothly to a second shaped end 26*b* having the appropriate cross-section for sealably mating with the second duct portion 12*b* of the duct 12. In this regard, it is desired for the outlet port adapter 26 to taper between the aperture 24 of the baffle and the second duct portion 12*b* so that air flow from the blower 20 to the second duct portion is facilitated with minimum back pressure. This is preferably achieved by sealably connecting the outlet port adapter to the housing at the periphery of the baffle.

Located between the inlet port 16 and the housing 14 is an inlet port adapter 28. The inlet port adapter has a first shaped end 28*a* that sealably connects with a first end 14*a* of the housing and a second shaped end 28*b* having the appropriate cross-section for sealably mating with the first duct portion 12*a* of the duct 12. While an aerodynamic tapered shape for the inlet port adapter 28 is shown in the Drawing, this is not a requirement. Indeed, for space saving purposes the inlet port adapter is preferred to be in the form of a flat wall connected with the housing to which is directly connected the end 28*b* that is shaped to sealably mate with the first duct portion 12*a*.

Accordingly, the aforesaid structure results in a two chamber blower system needed for the blower 20 to supply air movement along the duct 12. The two chambers, an inlet chamber 30*a* and an outlet chamber 30*b*, are sealably separated by the baffle 22. The inlet chamber 30*a* is fluidically connected with the inlet port 16 and has situate therein the blower 20. Negative air pressure is created in the inlet chamber 30*a* by action of the blower sucking air from the first duct portion 12*a*. The outlet chamber 30*b* is fluidically connected with the outlet port 18. Positive air pressure is created by the blower 20 blowing air into the second duct portion 12*b*.

The electric motor 20*c* is powered by connection to an electric utility via an electrical cord 32 which is sealably connected with respect to the housing 14. Control of operation of the motor is conventional through an exterior electrical circuit 32*a* well known in the art.

It is preferred for the housing to include a mount for connecting the blower system 10 to a building structure, such as adjacent floor joists. In this regard, a pair of flanges 34*a*, 34*b* are provided at either side of the housing 14, each flange having holes 34' for receiving therethrough common fasteners such as screws.

Figure 2:
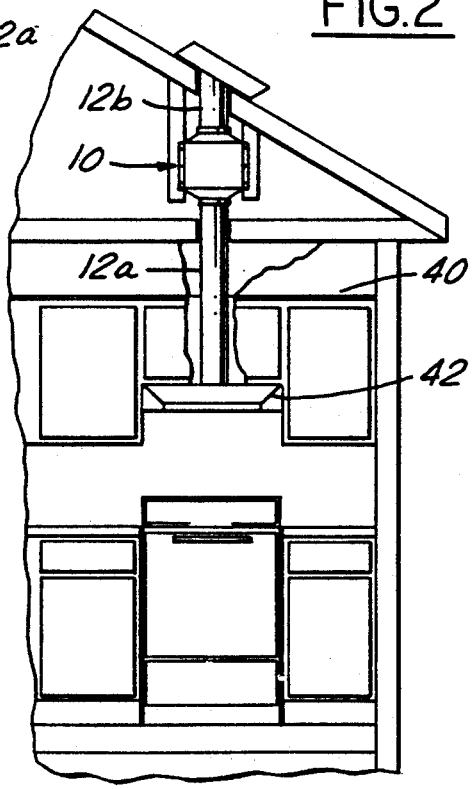
FIG. 2 is a side view of the blower system according to the present invention shown in a first typical installation location.
Figure 3:
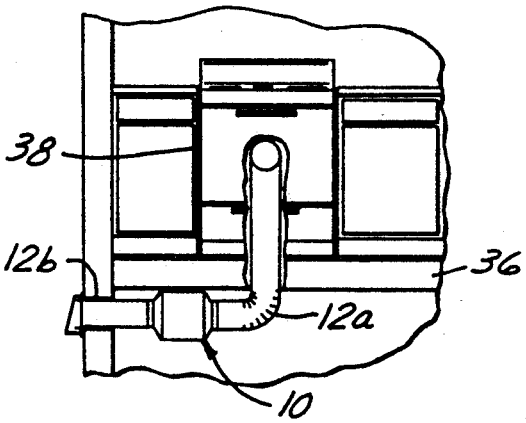
FIG. 3 is a side view of the blower system according to the present invention shown in a second typical installation location.

Operation of the blower system 10 according to the present invention will now be detailed with reference being made to FIGS. 1, 2 and 3.

The first and second duct portions of the duct are connected and installed with a gap therebetween sufficient to accommodate installation of the blower system. Alternatively, a single unit duct may be cut to accommodate the blower system 10 at any location therealong. The inlet port is connected to the first duct portion of the duct, while the outlet port of the blower system is connected to the second duct portion of the duct. Thereupon, the electrical cord is connected with an external electrical circuit.

Installation choices are unrestricted and may include horizontal and vertical orientations, or anything therebetween. Further as shown in FIG. 3, installation can be under the floor 36, where the blower system 10 connects with a duct from an appliance 38; or as shown in FIG. 2, installation can be above the ceiling 40, where the blower system connects with a duct from a range hood 42. In any event, the blower system according to the present invention permits installation of the blower anywhere along the duct to reduce or eliminate problems associated with vibration, environmental exposure, noise and appearance.

To those skilled in the art to which this invention appertains, the above described preferred embodiment may be subject to change or modification. For instance, the first and second duct portions may be any structure in which ducting of air is involved. Further, the blower may have more than one air outlet, there then being an aperture in the baffle for each. Such change or modification can be carried out without departing from the scope of the invention, which is intended to be limited only by the scope of the appended claims.

What is claimed is:

1. A blower system for being connected with a duct, the duct having a first portion and a second portion, said blower system comprising:

a housing having a first end and a second end;

an inlet adapter having a first end and a second end, said first end of said inlet adapter being sealably connected with said first end of said housing, said second end of said inlet adapter being structured to form an inlet port for sealably connecting to the first portion of the duct;

an outlet adapter having a first end and a second end, said first end of said outlet adapter being sealably connected with said second end of said housing, said second end of said outlet adapter being structured to form an outlet port for sealably connecting to the second portion of the duct, said outlet adapter having a shape that is aerodynamically tapered smoothly between said second end of said housing and said outlet port;

a baffle sealably connected to said second end of said housing, said baffle having an aperture defined by a perimeter, said baffle providing an air inlet chamber on one side thereof which fluidically communicates with said inlet port, said baffle further providing an air outlet chamber on the other side thereof which fluidically communicates with said outlet port;

a standard totally enclosed high capacity centrifugal blower located within said inlet chamber, said blower having at least one air inlet fluidically connected with said inlet chamber and one air outlet, said air outlet having an air passage and a mounting structure adjacent said air passage for providing mounting of said blower to said baffle at said perimeter of said aperture so as to provide fluidic connection of said air outlet with said outlet chamber, said aperture and said air passage having substantially identical dimensions; and electrical connection means for providing connection of said blower means to a source of electrical power;

wherein said shape of said outlet adapter provides minimal air back pressure at said outlet port when said blower is actuated.

2. The blower system of claim 1, wherein said housing further comprises mounting means for mounting said housing to at least one structural member.

3. The blower system of claim 2, wherein said mounting means comprises a pair of flanges structured for mounting said housing between joist members of a building.

* * * * *